United States Patent [19]

Diehl et al.

[11] Patent Number: 4,630,421

[45] Date of Patent: Dec. 23, 1986

[54] ROOF WEB FOR PITCHED ROOFS

[75] Inventors: Hermann Diehl, Mannheim; Günter Baatz, Buxheim; Walter Machholz, Memmingen, all of Fed. Rep. of Germany

[73] Assignee: Metzeler Schaum GmbH, Memmingen, Fed. Rep. of Germany

[21] Appl. No.: 803,134

[22] Filed: Nov. 29, 1985

[30] Foreign Application Priority Data

Nov. 29, 1984 [DE] Fed. Rep. of Germany ..... 3443581
Oct. 30, 1985 [DE] Fed. Rep. of Germany ..... 3538597

[51] Int. Cl.[4] ..... E04B 7/00

[52] U.S. Cl. ..... 52/408; 52/309.4; 52/404

[58] Field of Search ..... 52/408, 309.4, 309.7, 52/407, 404, 409, 410, 745, 309.8; 428/228

[56] References Cited

U.S. PATENT DOCUMENTS

| | | | |
|---|---|---|---|
| 4,045,922 | 9/1977 | Elliott | 52/408 X |
| 4,241,555 | 12/1980 | Dickens | 52/309.7 X |
| 4,434,601 | 3/1984 | Zellmer | 52/407 X |
| 4,557,092 | 12/1985 | Brueske | 52/408 X |
| 4,558,550 | 12/1985 | Marchais et al. | 52/408 X |

*Primary Examiner*—J. Karl Bell

*Attorney, Agent, or Firm*—Herbert L. Lerner; Laurence A. Greenberg

[57] ABSTRACT

A roof web for pitched roofs includes a vapor diffusion permeable but surface water impermeable foil, a reinforcement disposed below the foil, and an open-pore soft foam material disposed below the reinforcement and connected to the foil through the reinforcement, the reinforcement being a tear-proof grid fabric with a diffusion equivalent air layer thickness of substantially 0.07–0.12 m.

14 Claims, 2 Drawing Figures

ROOF WEB FOR PITCHED ROOFS

Figure 1:
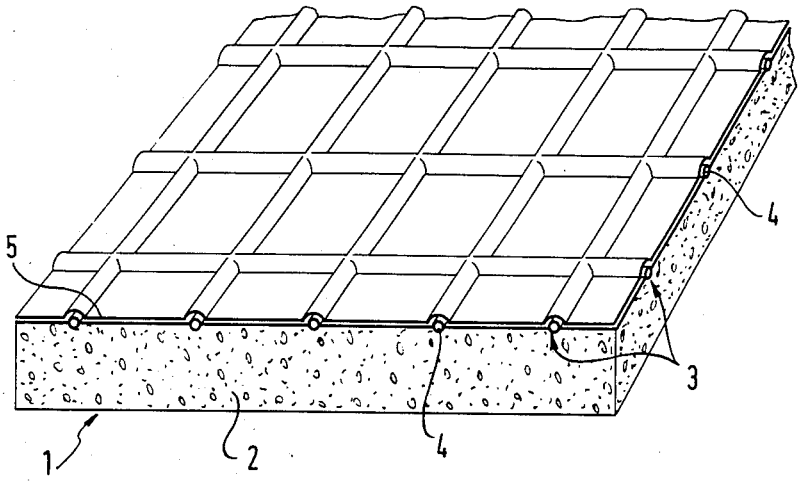

The invention relates to a roof web for pitched roofs, including a foil that is permeable to vapor diffusion but impermeable to surface water, and another layer.

Under certain weather conditions, moisture from room air penetrates into the heat insulation of roofs and can lead to unwanted moisturization and therefore to the partial loss of heat insulating features when the temperature falls below the dew point. This occurs if the heat insulation is covered from above for reasons of pollution prevention or because of the draining of surface water. This is the reason that it was heretofore neccessary to leave a ventilating space between the heat insulation and the upper covering.

European Application No. EP-A 0 046 944 discloses a heat insulation of a steep roof in the area between the rafters, in which the lamination coating web or course that serves as the roof web only has a low water vapor permeability, i.e. a high water vapor diffusion resistance.

In contrast to this, it is an object of the invention to provide a roof web for pitched roofs, which overcomes the hereinaforementioned disadvantages of the heretofore-known devices of this general type, which has only a very low water vapor diffusion resistance, yet is still impermeable to surface water and is very flexible and adjusts well to the unevenness of the roof or the heat insulation layer lying below, while still having a satisfactory tensile strength and which in particular does not require a ventilating space between the roof web and the insulating material.

With the foregoing and other objects in view there is provided, in accordance with the invention, a roof web for pitched roofs, comprising a vapor diffusion permeable but surface water impermeable foil, a reinforcement disposed below the foil, and an open-pore soft foam material disposed below the reinforcement and connected to the foil through the reinforcement, the reinforcement being a tear-proof or high tensile strength grid fabric with a diffusion equivalent air layer thickness of substantially 0.07–0.12 m.

The insertion of such a reinforcement makes it possible to manufacture a roof web with an extremely thin foil that distinguishes itself through high water vapor permeability, in spite of its impermeability to rain. Despite favorable diffusion specifications, the roof web is so strong that it withstands all of the strains that occur on the construction site. Moreover, the foam rubber provides for additional sound damping besides the good adjustment to unevenness of the roof which is caused by the construction process; this sound muffling is particularly advantageous if placed on heat insulating plastic foam plates made from styrofoam, polyurethane or similar products.

In accordance with another feature of the invention, the foil has a thickness of substantially 20–40 μm and preferably 25–30 μm.

In accordance with a further feature of the invention, the foil is formed of polyurethane.

In accordance with an added feature of the invention, the foil has a reflecting upper surface. This is done in order to reflect solarization and thereby to improve the insulation even further.

In accordance with an additional feature of the invention, the grid fabric is formed of polyester.

In accordance with again another feature of the invention, the grid fabric is formed of filaments with a diameter of substantially 0.3–1.0 mm and preferably 0.5–0.8 mm with mesh apertures of substantially 6–20 mm and preferably 8–12 mm formed therebetween.

In accordance with again a further feature of the invention, the open-pore soft foam material is formed of polyether-polyurethane and has a thickness of substantially 2–12 mm and preferably 4–8 mm.

In accordance with again an added feature of the invention, the grid fabric is formed of a mesh of filaments with regions formed therebetween, and the foil is at least partially connected with the foam material at the regions between the filaments. This is done in order to achieve a good overall stability.

In accordance with again an additional feature of the invention, the soft foam material, grid fabric and foil are flame laminated to each other.

In accordance with still another feature of the invention, there are provided rafters disposed directly below the foam material, insulation disposed between the rafters, and a counter lath fastening the roof web to the rafters.

In accordance with a concomitant feature of the invention, there is provided an insulating system of stiff insulation plates disposed directly between the rafters and the roof web.

Other features which are considered as characteristic for the invention are set forth in the appended claims.

Although the invention is illustrated and described herein as embodied in a roof web for pitched roofs, it is nevertheless not intended to be limited to the details shown, since various modifications and structural changes may be made therein without departing from the spirit of the invention and within the scope and range of equivalents of the claims.

Figure 2:
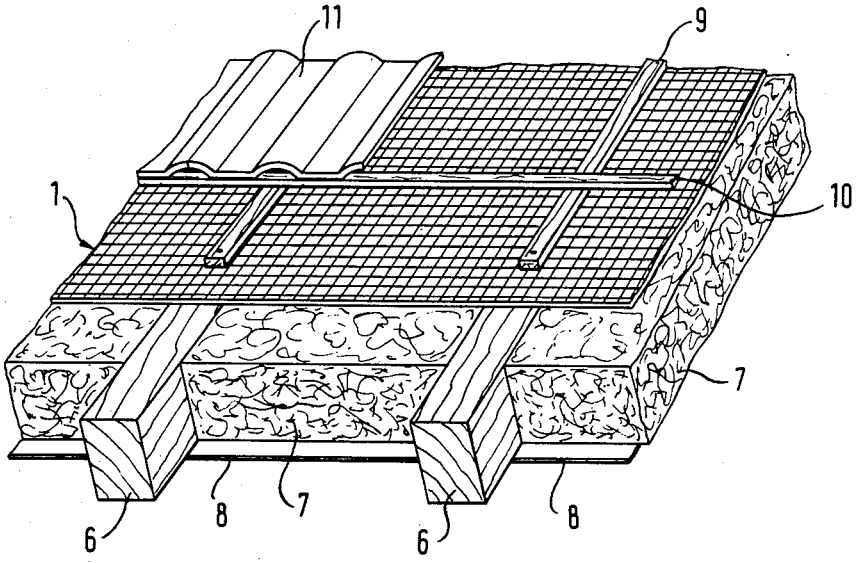

The construction and method of operation of the invention, however, together with additional objects and advantages thereof will be best understood from the following description of specific embodiments when read in connection with the accompanying drawings, in which:

FIG. 1 is a diagrammatic perspective view of a section of a roof web on an increased scale; and FIG. 2 is a perspective view, partially broken away, of the disposition of the roof web on a steep roof.

Referring now to the figures of the drawings in detail and first, particularly, to FIG. 1 thereof, there is seen a roof web 1 which practically speaking is formed of three layers, namely a soft foam layer 2, a grid fabric reinforcement 3 with filaments 4, as well as a covering foil 5 which may have an upper solar reflective surface.

The foil 5, which is advantageously formed of polyurethane, has a thickness of 20–40 μm, in particular 25–30 μm. According to DIN 53455, the elasticity is 550–600% and the breaking strength is 50–75 N/mm$^2$. The water vapor permeability at 38° C. and 90% relative humidity for a 30 μm thick polyether foil measured according to DIN 53122, comes to 350 g/m$^2$d and to 900 g/m$^2$d for a corresponding polyurethane foil. The water pressure check against surface water according to DIN 53886 led to values of over 1500 mm WS (equivalent to 165 mbar). Moreover, the foil can be equipped with fire retarding additives.

The reinforcement 3 that is disposed below the foil 5 is formed of a grid fabric or grid web which can be manufactured by knitting, weaving, interweaving, tying (binding) or coextrusion of filaments 4 that cross each other, and it is equipped with fixed or loose crossing points. The mesh apertures are 6–20 mm, in particular 8–12 mm. The individual filaments 4 have a thickness of 0.3–1 mm, in particular 0.5–0.8 mm, so that a warp or weft can also be formed of individually disposed threads in the form of a strip or small band with a width of 0.3–3 mm, especially 0.5–1.5 mm.

Advantageously, the foam layer 2 is an open-pore polyetherpolyurenthane soft foam material with a raw density of 25–45 kg/m$^3$, in particular 30–35 kg/m$^3$ and with a thickness of 2–12 mm, in particular 4–8 mm, which has a breaking strength larger than 88 kPA according to DIN 53571. The water permeability should be 100–300 l/min 100 cm$^2$, in particular 160–200 l/min 100 cm$^2$ in the case of a 10 mm water column pressure and a 50 mm sample thickness.

The three layers, namely the foil 5, the grid fabric 3 and the foam material layer or web 2 are connected with each other by means of flame lamination. By doing this, the filaments 4 of the grid fabric 3 are partially embedded into the foam material web 2, the entire surface of the foil 5 is glued together with the foam material and at least sections thereof are glued together with the filaments 4 of the grid fabric 3. This also increases the breaking strength of the roof web and inhibits warping through folding or rolling. At the same time the diffusion of water vapor is facilitated because of the undisturbed transition area of the foil 5 between the grid fabric 3 and the foam material 2.

An additional increase in strength is possible because the foil 5 is stretched. In the case of fire, this also has the advantage of causing the foil to shrink away and therefore inhibiting the spread of the fire.

In the same way, it is also possible to increase the strength of the filaments 4 of the grid fabric or grid layer 3 by stretching.

Overall, by especially equipping the three layers of the roof web, a low inflammability of a material of the class B1 or at least a material of the class 2 according to DIN 4102, can be achieved.

With the aid of FIG. 2, an embodiment of the roof web 1 on a steep roof will be explained in detail. First of all, the space between rafters 6 is filled over its entire height with insulating material 7, such as mineral wool. A lining in the form of a metal foil 8 can be attached to the bottom of the insulating material 7, serving as a vapor seal. For this purpose, a layer or a material is satisfactory, which has a diffusion equivalent air layer thickness of only 2 m. The roof web 1 according to the invention is attached on top of the rafters 6 and directly on the insulating material 7. It is advantageous to nail this roof web 1 onto the rafters 6 through a counter lath or lattice 9, which can also be referred to as furring or nailing strips. However, it is also possible to nail the roof web 1 directly onto the rafters 6 without the counter lath 9. Due to the relatively small mesh apertures of the grid fabric 3, the clamps that are usually used in the roofing trade always grab individual filaments, so that fast and sure application is possible even with unfavorable weather conditions, as for instance a strong wind. An actual lath 10 is then applied on the counter lath 9 and individual roofing tiles 11 are then placed on the lath 10.

It is advantageous to lay the roof web parallel to the eaves row by row from the bottom to the top, so that the overlap is governed by the inclination of the roof. Since the roof web according to the invention hardly slows vapor, the roof web can be assembled by going over the roof ridge or peak. The roof web 1 can also be placed directly on stiff insulating plates of an insulating system above the rafters.

The foregoing is a description corresponding in substance to German application Nos. P 34 43 581.6, filed Nov. 29, 1984 and P 35 38 597.9, filed Oct. 30, 1985, the International priority of which are being claimed for the instant application, and which are hereby made part of this application. Any material discrepancies between the foregoing specification and the aforementioned corresponding German applications are to be resolved in favor of the latter.

We claim:

1. Roof web for pitched roofs, comprising a vapor diffusion permeable but surface water impermeable foil, a reinforcement disposed below said foil, and an open-pore soft foam material disposed below said reinforcement and connected to said foil through said reinforcement, said reinforcement being a tearproof grid fabric with a diffusion equivalent air layer thickness of substantially 0.07–0.12 m.

2. Roof web according to claim 1, wherein said foil has a thickness of substantially 20–40 μm.

3. Roof web according to claim 1, wherein said foil has a thickness of substantially 25–30 μm.

4. Roof web according to claim 2, wherein said foil is formed of polyurethane.

5. Roof web according to claim 1, wherein said foil has a reflecting upper surface.

6. Roof web according to claim 1, wherein said grid fabric is formed of polyester.

7. Roof web according to claim 6, wherein said grid fabric is formed of filaments with diameter of substantially 0.3–1.0 mm with mesh apertures of substantially 6–20 mm formed therebetween.

8. Roof web according to claim 6, wherein said grid fabric is formed of filaments with a diameter of substantially 0.5–0.8 mm with mesh apertures of substantially 8–12 mm formed therebetween.

9. Roof web according to claim 1, wherein said open-pore soft foam material is formed of polyether-polyurethane and has a thickness of substantially 2–12 mm.

10. Roof web according to claim 1, wherein said open-pore soft foam material is formed of polyether-polyurethane and has a thickness of substantially 4–8 mm.

11. Roof web according to claim 1, wherein said grid fabric is formed of a mesh of filaments with regions formed therebetween, and said foil is at least partially connected with said foam material at said regions between said filaments.

12. Roof web according to claim 1, wherein said soft foam material grid fabric and foil are flame laminated to each other.

13. Roof web and pitched roof assembly, comprising a roof web formed of a vapor diffusion permeable but surface water impermeable foil, a reinforcement disposed below said foil, and an open-pore soft foam material disposed below said reinforcement and connected to said foil through said reinforcement, said reinforcement being a tear-proof grid fabric with a diffusion equivalent air layer thickness of substantially 0.07–0.12 m, rafters disposed directly below said foam material, insulation disposed between said rafters, and a counter lath fastening said roof web to said rafters.

14. Roof web according to claim 13, including an insulating system of stiff insulation plates disposed directly between said rafters and said roof web.

* * * * *